United States Patent [19]

Hansen

[11] 4,165,825

[45] Aug. 28, 1979

[54] TILTABLE VALVE MEMBER FOR PRESSURIZED CONTAINERS

[75] Inventor: Harold M. Hansen, Westfield, N.J.

[73] Assignee: Southern Can Company, Tuckahoe, N.Y.

[21] Appl. No.: 824,688

[22] Filed: Aug. 15, 1977

[51] Int. Cl.[2] ..... B65D 83/14

[52] U.S. Cl. ..... 222/402.22; 222/402.24; 222/513

[58] Field of Search ..... 222/153, 402.11, 402.21, 222/402.22, 402.23, 402.24, 513, 517, 521; 251/350, 354; 239/579

[56] References Cited

U.S. PATENT DOCUMENTS

| | | | |
|---|---|---|---|
| 2,582,262 | 1/1952 | Loven et al. | 222/402.23 |
| 2,766,913 | 10/1956 | Wilshusen | 222/402.22 |
| 3,249,261 | 5/1966 | Benediktson | 222/402.21 X |
| 3,450,316 | 6/1969 | Barker | 222/402.22 |
| 3,640,431 | 2/1972 | Plumer | 222/326 X |
| 3,722,760 | 3/1973 | Hug | 222/402.22 |
| 3,758,007 | 9/1973 | Rosen | 222/402.23 X |

*Primary Examiner*—Robert J. Spar
*Assistant Examiner*—Fred A. Silverberg
*Attorney, Agent, or Firm*—Dowell & Dowell

[57] ABSTRACT

A tiltable valve apparatus for use with pressurized containers in which the valve member is constructed of resilient material and includes a hollow shank with a substantially rigid reinforcing plug therein so that the valve stem can be tilted without bending when pressure is applied to one side for dispensing material from the container.

7 Claims, 5 Drawing Figures

TILTABLE VALVE MEMBER FOR PRESSURIZED CONTAINERS

BACKGROUND OF THE INVENTION

1. Field of the Invention

This invention relates generally to valve members of different kinds and relates particularly to valve members that are closed at one end and can be easily cut or severed and which are provided with a reinforcing structure so that the valve member can be tilted without bending.

2. Description of the Prior Art

Heretofore many efforts have been made to provide valve structures for dispensing materials of a pasty or viscous consistency from both pressurized and non-pressurized containers, and such valves have included tilt type valve members which normally are constructed of relatively rigid material and are mounted in one end of the container by means of a resilient grommet or the like so that when the valve member is tilted, an opening is provided between the valve and the grommet to permit the material to be dispensed. Some examples of this type of device are shown by the U.S. Pat. Nos. to Fredette et al 2,892,572; Michel 3,048,307; and Schultz 3,901,416.

Normally the valve member in this type of structure includes a valve and a hollow stem which is closed at the bottom by the valve and is open at the top so that when the valve member is tilted, the material is dispensed through the valve stem and is discharged at the upper end. Since the member is made of relatively rigid material, it can be tilted easily to one side to cause the valve to be unseated relative to the resilient grommet.

Another type of valve structure for dispensing material from a container is the tip-seal valve member in which a relatively rigid valve stem extends upwardly from a container and the lower end of such valve stem is surrounded by a resilient grommet; however, the upper end of the valve stem has one or more openings for discharging material laterally therefrom. In this type of structure, a cap is provided which normally engages the upper end of the valve stem when not in use so as to prevent material from being dispensed. Some examples of this type of structure are the U.S. Pat. Nos. to Barker 3,450,316; and Beard 3,506,165.

Another type of tip-seal valve member is disclosed in the Schultz U.S. Pat. No. 3,901,410 in which the valve stem is provided with a pin extending upwardly generally axially thereof and such valve member has a cap with an opening engaging the upper end of the pin to close the valve member when not in use. The lower portion of the cap normally engages the top of the container when not in use so that the valve stem cannot be accidentally tilted.

In addition, some containers, particularly non-pressurized containers, are provided with a dispensing nozzle which is closed at the outer end and which is constructed of a softer non-rigid thermoplastic material so that it can be cut with a knife or other sharp instrument after which an axial force is applied to the material within the container to cause the material to be dispensed through the nozzle. In relatively rigid containers, such as in caulking gun cartridges or the like, the axial force may be applied by a piston. In relatively flexible containers, such as squeeze tubes, the axial force may be applied by the hands of the user. In this type of structure, a thin film or seal normally is affixed to the base of the nozzle and such film must be punctured with a sharp instrument before the material can be dispensed. Ordinarily, relatively flexible dispensing nozzles are not used as tilting valve members for pressurized containers since they bend and do not unseat the valve.

SUMMARY OF THE INVENTION

The present invention is embodied in a tiltable valve member for use with pressurized containers, and such valve member is made of non-rigid or resilient thermoplastic material. The valve member includes a stem which is hollow and the outer end normally is closed so that material cannot be dispensed until after the end of the valve stem has been severed by a sharp bladed instrument to provide a discharge opening. An enlarged valve is attached to or integrally formed with the base or inner end of the valve stem and such stem has one or more openings adjacent to the valve which ordinarily are closed by a resilient grommet but which are opened when the valve stem is tilted. Since the valve member is made of non-rigid material and the inner end is weakened by the openings, a rigid reinforcing plug extends into the hollow valve stem from the inner end and such plug has at least one passageway to permit the material to pass. The reinforcing plug permits the valve member to be tilted so that the valve at the lower end of the stem is moved and thereby exposes the openings in the valve stem to the pressurized product within the container.

It is an object of the invention to provide a valve member for a pressurized container in which such valve member is made of resilient non-rigid material and the outer end is initially closed but may be severed with a sharp instrument to provide a discharge opening.

Another object of the invention is to provide a hollow valve stem of non-rigid material having a rigid reinforcement at one end to permit such stem to be easily tilted to a discharge position.

DESCRIPTION OF THE PREFERRED EMBODIMENTS

Figure 1:
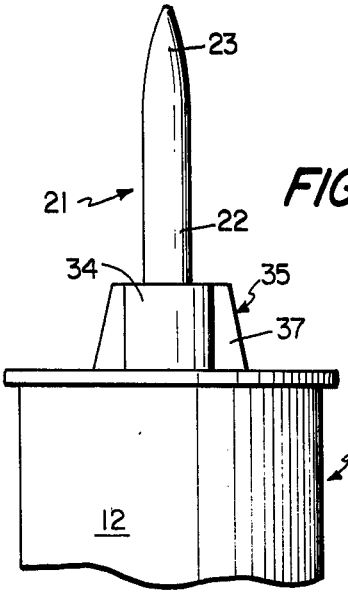
FIG. 1 is a fragmentary side elevation of a pressurized container illustrating one application of the invention.

With continued reference to the drawing, a pressurized container 10 is provided having an end wall 11 at each end with only the upper wall being shown. The end walls 11 are crimped, welded or otherwise sealingly attached to the cylindrical side wall 12 of the container. The end walls may be of either convex or concave configuration and normally the interior of the container is divided into two compartments by a floating piston (not shown). The upper compartment contains a flowable pasty or viscous product, such as caulking compound, adhesives and the like, to be dispensed, and the lower compartment contains a pressurized fluid medium, such as air, which urges the floating piston toward the product to be dispensed.

The upper end wall 11 has an opening 13 located generally centrally thereof and such opening receives a resilient grommet 14 having an enlarged head 15. The upper end of the head 15 engages the inner periphery of the end wall 11, while the lower end forms a valve seat 16. A sleeve 17 extends upwardly from the head 15 and is press-fitted into the opening 13. Preferably the sleeve 17 is provided with a bead 18 which engages the upper surface of the end wall for retaining the grommet in position. The grommet 14 has an axial bore 19 which communicates with a counterbore or recess 20 in the lower end of the head 15.

Figure 3:
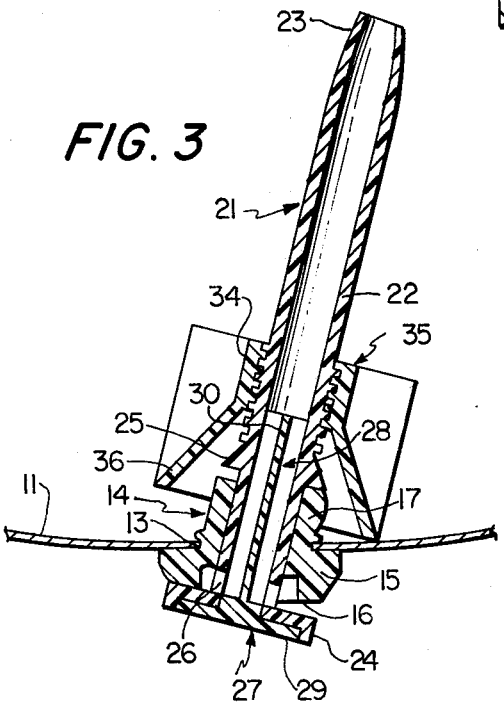
FIG. 3 is a section similar to FIG. 2 showing the valve member in a dispensing position.

A valve member 21 is provided having a hollow stem 22 mounted within the bore 19 of the grommet and such valve member normally is made of a flexible non-rigid thermoplastic material which can be severed or cut with a sharp instrument, such as a razor blade, knife, scissors or the like. Preferably the outer end or tip 23 of the stem 22 is blind or closed during the manufacture thereof by forming the valve stem around a mold pin which extends inwardly from the inner end. The stem 22 ordinarily is generally cylindrical throughout most of its length and is of substantially constant thickness; however, the outer end 23 preferably tapers inwardly and may have a progressively reduced thickness to facilitate cutting and removal of a portion of the tip to provide a discharge opening, as shown in FIG. 3. At the inner end of the valve member, a cup shaped valve or enlargement 24 is integrally formed with the stem 22 and such valve is adapted to engage the valve seat 16 of the grommet to prevent the introduction of material to be dispensed into the counterbore 20.

The stem 22 is provided with a collar or outwardly extending flange 25 which engages the upper end of the sleeve 17 of the grommet 14, and such collar, together with the pressure of the material within the container, normally maintains valve 24 in sealing engagement with the valve seat 16 of the grommet. Adjacent to the valve 24, the stem 22 is provided with a plurality of openings 26 so that when the valve is unseated, material from the container flows into the counterbore 20 and through the openings 26 into the interior of the hollow stem so that such material can be dispensed through the discharge opening after the tip has been removed or otherwise ruptured.

Figure 4:
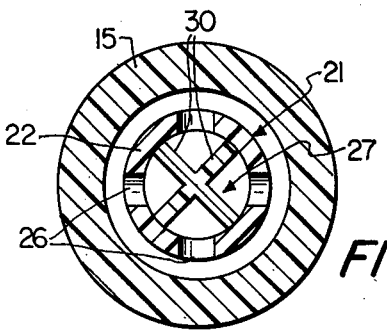
FIG. 4 is an enlarged section on the line 4—4 of FIG. 2.

The valve member 21 normally is operated by tilting the stem to one side to cause the valve 24 to be unseated from the valve seat 16. However, since the valve member is made of non-rigid thermoplastic material and is further weakened by the openings 26, it is important to provide a reinforcement for the inner end of the valve member. In order to do this a reinforcing plug 27 is provided which preferably is molded of a substantially rigid thermoplastic or thermosetting material. As illustrated best in FIGS. 2, 3 and 4, the reinforcing plug 27 includes an elongated body 28 having a head 29 at one end. Such head 29 preferably has a configuration generally complementary to the interior of the valve 24 and preferably is adhered thereto by a conventional adhesive (not shown). Although the valve 24 has been illustrated and described as being cup shaped, it is contemplated that such valve could be of any desired configuration, including being flat or generally frusto-conical.

Normally four openings 26 are provided in the base of the stem 22 adjacent to the valve 24 so that material to be dispensed can flow through the valve member 21 regardless of the direction of tilting of such member. In order to reinforce the inner end of the valve member without significantly reducing the flow of material through the openings 26, the body 28 of the reinforcing plug is provided with a plurality of outwardly extending webs or projections 30 which engage the inner periphery of the hollow stem and such webs define a plurality of longitudinally extending passageways to permit egress of the material through the valve member. In this embodiment, the number of webs of the reinforcing plug 27 is substantially equal to the number of openings 26 and, therefore, such plug should be oriented with regard to the valve stem so that the webs 30 are not in alignment with the openings 26, as illustrated best in FIG. 4.

When the reinforcing plug 27 is in position with the webs 30 engaging the inner periphery of the valve stem, the lower portion of the valve stem is rigidified by the reinforcing plug so that tilting of the upper portion of the valve member causes the valve 24 to be unseated from the valve seat 16 of the grommet and permits material to flow through the valve stem so that such material can be dispensed.

Figure 2:
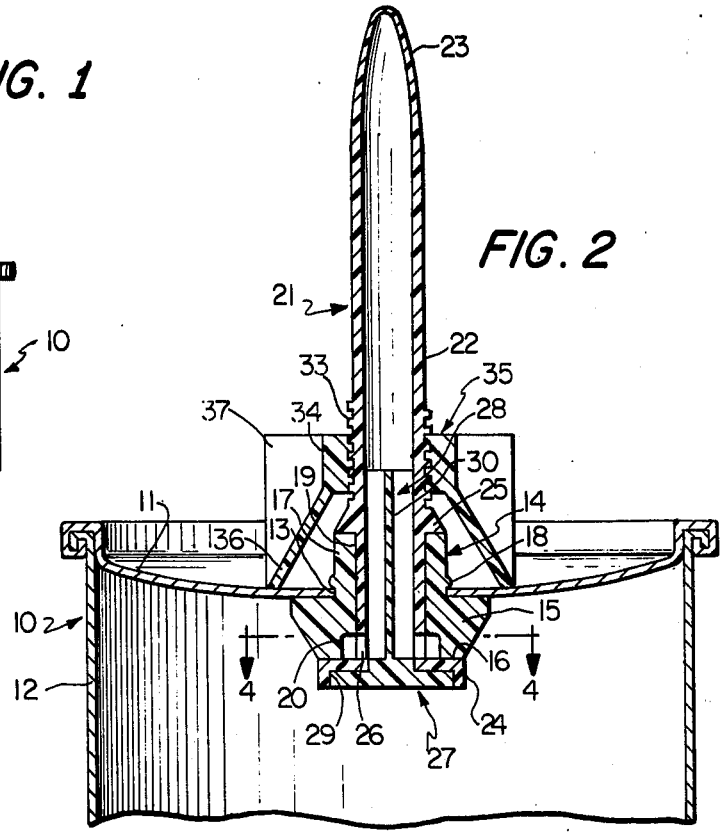
FIG. 2 is an enlarged vertical section of the valve member and container in closed position.

With particular reference to FIGS. 2 and 3, the outer periphery of the stem 22 in the area above the collar 25 may be provided with external screw threads 33 which threadedly engage cooperating threads in the body 34 of a locking member 35. The body 34 normally has a downwardly and outwardly flaring skirt 36. The locking member 35 includes a pair of opposed outwardly extending finger-engaging flanges 37 to assist in rotating the locking member. When the locking member is screwed downwardly, as illustrated in FIG. 2, the lower end of the skirt engages the end wall 11 and prevents any tilting of the valve member. When it is desired to dispense material, the locking member is screwed upwardly a desired distance so as to control the flow of material through the valve member. When the locking member is moved a short distance and the valve member is tilted, the edge of the skirt 36 engages the end wall 11 when the valve 24 is barely unseated so that only a small amount of material is slowly dispensed. As the locking member is moved upwardly along the stem, the opening between the valve 24 and the valve seat 16 of the grommet is increased and accordingly the flow of material likewise is increased.

Figure 5:
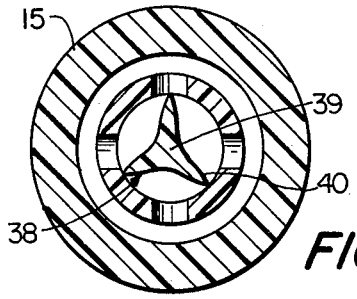
FIG. 5 is an enlarged section similar to FIG. 4 of another embodiment of the invention.

With particular reference to FIG. 5, another embodiment of reinforcing plug 38 is provided including a body 39 integrally attached to a head (not shown) but which is similar in construction to the head 29 of the reinforcing plug 27. In order to avoid the necessity of orienting the reinforcing plug 38 relative to the openings 26 in the valve stem, the body 39 is provided with a plurality of outwardly extending fins or projections 40 which taper from the central portion to a sharp edge which engages the interior of the hollow stem 22. In this construction it is not necessary that the number of fins be equal to the number of openings 26 since the sharp edges at the outer portion of the fins will not substantially affect the flow of material through the openings even if the fins are aligned therewith. As illustrated in FIG. 5, the stem 22 is provided with four openings 26, while the reinforcing plug 38 has three fins 40 and one of the fins is in alignment with one of the openings.

It is noted that the reinforcing plug 27 or 38 extends from the valve 24 upwardly through the hollow stem and terminates substantially above the collar 16 of the grommet 14 to provide rigidity to the valve member in the area of the grommet so that the valve 24 can be unseated from the valve seat 16 when the valve member is tilted.

In the operation of the device, the valve member 21 is molded in a die having a mold pin extending upwardly from the valve portion of the member in such a manner that the valve stem 22 is closed at the outer end thereof. After the valve member has been molded and the mold pin has been removed, a reinforcing plug which has been molded separately of substantially rigid material is inserted into the valve stem 22 through the valve 24 so that the body of the reinforcing plug extends upwardly into the hollow stem, while the head of the plug is attached to the valve. Thereafter, the valve stem is inserted into the grommet 14 and the grommet in turn is forced through the opening 13 in the end wall 11 of the container, after which material to be dispensed is placed within the container and is subjected to a pressurizing medium such as air under pressure or the like.

When it is desired to dispense the material, a sharp instrument, such as a razor blade, knife or the like, is used to cut the tip from the outer end 23 to provide a discharge opening. The specific location of the cut determines the size of the discharge opening since the outer end of the valve stem is tapered. If it is determined that the first cut does not provide a sufficiently large discharge opening, then one or more additional cuts may be made until the discharge opening is of a desired size. Since the valve stem is made of at least semi-flexible material, the outer end of the valve stem may be cut where desired.

When material is to be dispensed from the container, one side of the valve member 21 is subjected to a lateral pressure to unseat the valve 24 from the valve seat 16 and permit material from within the container to flow through the counterbore 19 and the openings 26 into the valve stem so that such material is discharged through the open outer end of the stem. If the material being dispensed is a viscous product such as caulking compound or the like, the angle of tilting of the stem can be kept constant as the container is moved at a constant rate by the user. Under these conditions, a substantially perfect bead of material is dispensed from the container which continues until the lateral pressure is relieved from the valve member or all of the material has been discharged from the container.

I claim:

1. A tiltable valve member for selectively dispensing viscous material from a pressurized container having a resilient grommet with a valve seat, said valve member comprising an elongated hollow stem of non-rigid thermoplastic material which may be cut with a sharp instrument, at least one end of said stem being open, valve means attached to said stem adjacent to said open end and normally engaging the valve seat, said valve stem having at least one inlet opening extending into the hollow interior above said valve means, plug means mounted in said open end of said valve stem, said plug means including a body of relatively rigid material for engaging the inner periphery of said hollow stem to reinforce said stem, one end of said body being located below said inlet opening and the other end terminating at a position above the resilient grommet, said plug means including an enlarged head integrally connected to said one end of said body, said head intimately engaging said valve means, and said body having at least one passageway of a size such that flow of material through said opening is not significantly reduced, said passageway communicating with said inlet opening and extending from a position below said opening to said other end so that when said valve means is unseated material is forced through said opening and can pass through said valve stem.

2. The structure of claim 1 in which the other end of said stem is closed, the tip of said closed end being removed prior to use.

3. The structure of claim 1 in which said body includes a plurality of projections for engaging the inner periphery of said stem and defining a plurality of passageways.

4. The structure of claim 3 in which said valve stem has more than one inlet opening extending into said hollow stem, said body including a corresponding number of projections, and said projections being oriented out of alignment with said openings.

5. The structure of claim 3 in which said valve stem has more than one inlet opening extending into said hollow stem, and said body has a different number of projections.

6. The structure of claim 5 in which at least one of said openings is not covered by a projection.

7. A tiltable valve member for selectively dispensing viscous material from a pressurized container having a flexible grommet with a valve seat, comprising an elongated hollow stem constructed of non-rigid thermoplastic material, said valve stem being closed at one end and open at the other end, a valve fixed to said open end of said stem, said valve normally engaging the valve seat of said grommet, said valve stem having a plurality of openings extending into said hollow stem above said valve and normally positioned within said grommet, reinforcing plug means having a body of relatively rigid material extending into said hollow stem through said open end, one end of said body being located adjacent to said valve and the other end terminating at a position above the flexible grommet, said body including a plurality of outwardly extending projections engaging the inner periphery of said stem and defining passageways of a size such that the flow of material to be dispensed is not significantly reduced, said passageways communicating with said openings in said valve stem, and said reinforcing plug means including an enlarged head integrally connected to said one end of said body, said head intimately engaging said valve and being secured in fixed position within said stem.

* * * * *